US005178311A

United States Patent [19]

McBride

[11] Patent Number: 5,178,311

[45] Date of Patent: Jan. 12, 1993

[54] NECK-SUPPORTED MAP HOLDER

[76] Inventor: Timothy B. McBride, 1110 Vermong Ave., NW., Washington, D.C. 20005

[21] Appl. No.: 606,624

[22] Filed: Oct. 31, 1990

[51] Int. Cl.[5] ..... A45F 3/02

[52] U.S. Cl. ..... 224/191; 224/202; 224/257; 40/904

[58] Field of Search ..... 224/202, 205, 207, 191, 224/257; 40/1.5, 644, 904, 586, 665, 633; 150/145

[56] References Cited

U.S. PATENT DOCUMENTS

| | | | |
|---|---|---|---|
| 1,545,577 | 7/1925 | Arms | 150/145 |
| 3,734,155 | 5/1973 | Stenger | 40/1.5 |
| 3,810,566 | 5/1974 | Adams et al. . | |
| 4,249,330 | 2/1981 | Chioffe . | |
| 4,415,106 | 11/1983 | Connell et al. . | |
| 4,570,688 | 2/1986 | Williams | 224/205 |
| 4,795,069 | 1/1989 | Ferrill | 224/202 |

FOREIGN PATENT DOCUMENTS

| | | | |
|---|---|---|---|
| 542202 | 12/1941 | United Kingdom | 224/222 |

*Primary Examiner*—Linda J. Sholl

*Attorney, Agent, or Firm*—Antonelli, Terry, Stout & Kraus

[57] ABSTRACT

Disclosed is a map holder, which can have a ski area trail map and/or related printed information therein for use by a skier. The map holder includes a string or elastic to be positioned around the neck of the skier, with a map supporting member attached to the string or elastic. The map or other information is exposed in the map supporting member. The string or elastic is sufficiently long (or can be stretched to a sufficient length) so that the map can be read by the skier or a companion without the string or elastic being removed from around the neck of the skier. Thus, without removal of the string or elastic from around the neck of the skier, the map can be read by the skier or companion or placed in a protected, non-visible location (e.g., inside a ski jacket worn by the skier).

23 Claims, 4 Drawing Sheets

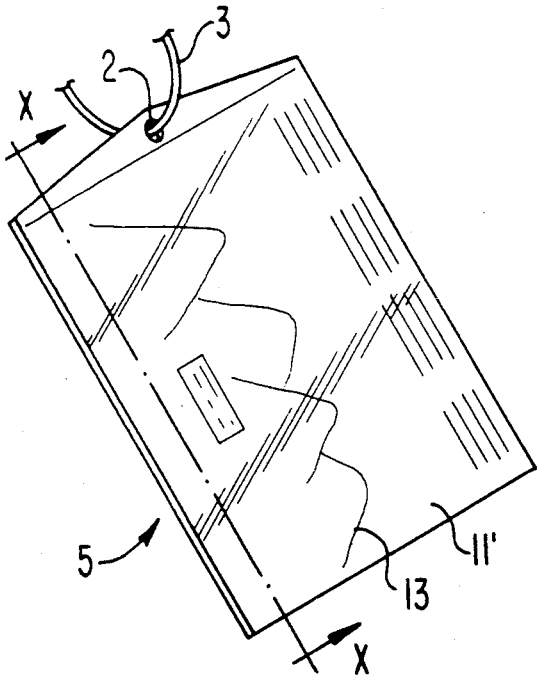
FIG. 7A
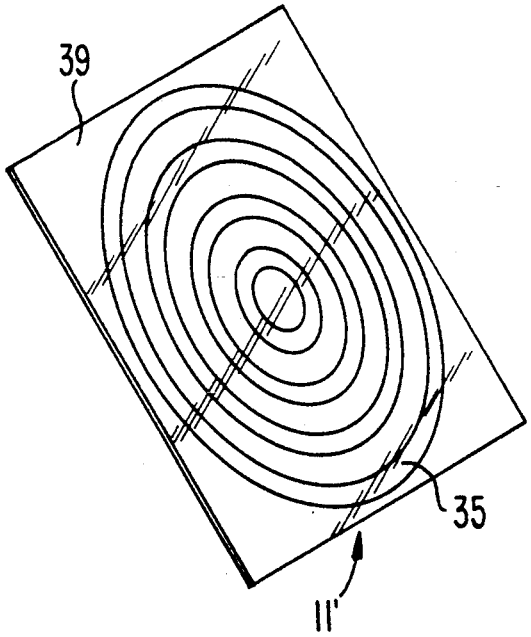
FIG. 7B
FIG. 8
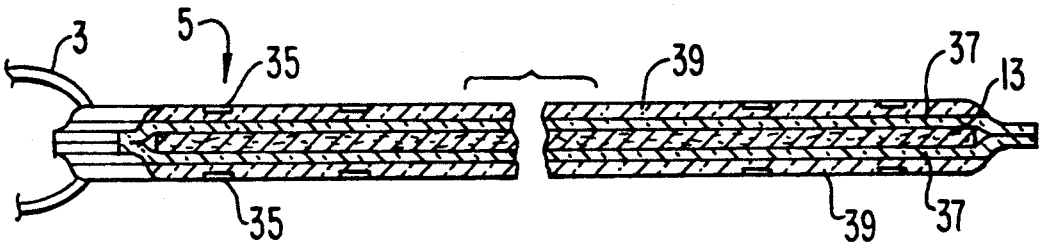

NECK-SUPPORTED MAP HOLDER

BACKGROUND OF THE INVENTION

The present invention relates to a map holder (or holder of other information, particularly printed information) that is accessible to the person possessing the map, or a companion, but which can be kept, when not being read for the information thereon, in a protected and non-visible location. More particularly, the present invention is directed to a map holder for a ski area trail map, which is easily accessible to the skier or a companion when needed (for example, while the skier is on a chair lift or stopped on a trail) but which can be stored in a protected and non-visible location while the person is skiing, if desirable or appropriate.

While the present invention will primarily be described in connection with a map holder for holding ski area trail maps, e.g., for downhill skiers, the present invention is not so limited, and has application in other areas where information is necessary at certain times, so that the information must be readily accessible, but where it is desired to protect the information (printed information) and the holder for such printed information; for example, map holders for cross-country skiers, for hikers, for pilots, for tourists, etc.

The use of a paper ski area map by carrying it on the skier's person, such map usually being made available at no cost to the skier by the ski area, has been a conventional practice for some time. Generally, such ski area trail maps are pocket-size fold-ups of larger maps. Skiing apparel is generally amply supplied with zippered or otherwise sealable pockets, and generally the pocket-size fold-up ski area maps have been held in such pockets. However, such maps, stored in such pockets, are awkward to use. Specifically, to use such maps, it is necessary, in most circumstances, to remove gloves and ski poles to access pockets and remove the map therefrom, and unfold the map for use. The activity of removing gloves and possibly ski poles, in handling the map, particularly when such activity takes place on a chair lift, increases the possibility of dropping a glove and/or ski pole and losing such glove or pole, with possible injury to others. Also, such paper maps are easily dropped, adding litter to the ski terrain, which is both unsightly and possibly even dangerous to skiers.

U.S. Pat. No. 4,415,106 to Connell, et al addresses this problem of inaccessible ski maps. This U.S. Pat. No. 4,415,106 avoids the problem by providing a ski area map holder designed to be strapped onto a skier's arm or leg. The map holder consists of two elements: a primary element being a planar support element for holding the map, the planar support element being a pliable structure, the planar support element being shaped to provide a rectangular map supporting section at its center and male and female strap sections; and a translucent map enclosing element. The male and female strap sections are sufficiently long such that the planar support element can be positioned on an arm or leg of the skier, where the map is readily available for reference purposes without removal of gloves or mittens or of ski poles. This patent also discloses that an elastic band, rather than strap sections, can be used for maintaining the map holder on the skier's arm; that the map can be printed directly on, or adhesively secured onto, an exposed portion of the support element; and that the map can be permanently incorporated into a plastic lamination. The contents of U.S. Pat. No. 4,415,106 are incorporated herein by reference in their entirety.

While this patent addresses the problem of providing an accessible ski map, the device described in U.S. Pat. No. 4,415,106 has drawbacks and is limited. Thus, the map holder in U.S. Pat. No. 4,415,106 is always exposed to the elements, and the map holder (and map held thereby) can be damaged by the elements during normal activities (for example, if the skier falls during skiing). In addition, the positioning of the map holder of U.S. Pat. No. 4,415,106 can be changed during, e.g., a fall while skiing, and could actually be lost.

Furthermore, ski outfits are made with specific designs, typically fashion-driven, and a map holder as in U.S. Pat. No. 4,415,106, always externally provided on a skier's arm or leg, can destroy the desired design and overall image of the ski outfit.

In addition, U.S. Pat. No. 4,415,106 does not disclose a holder for a map of reduced size, with, for example, magnifying means, or a holder for a map of double-size (e.g., for a map having twice as much map area on one side, or for a map having trails shown on both sides). Moreover, during activities such as, e.g., hiking, positioning of the holder on the arm or leg of the hiker can be uncomfortable.

U.S. Pat. No. 4,249,330 to Chioffe discloses a device worn or carried on a person and having the appearance of a piece of jewelry so as to be attractive, yet being viewable to provide medical information about the person. Specifically, this U.S. Pat. No. 4,249,330 discloses an elongated but small metal capsule, attached to a necklace type of chain so that it may be worn around the neck as a necklace, the capsule having at one end a small amplifying lens and having a film or microfilm containing medical information at the other end. This patent further discloses that in an emergency a doctor or other skilled personnel can quickly obtain background medical history for proper treatment.

U.S. Pat. No. 3,810,566 to Adams, et al discloses apparatus adapted to make a patient's medical record immediately available to an attending physician, the apparatus including, in combination, at least one microfilm chip bearing medical indicia and a receptacle for the chip adapted for attachment to the human body, the receptacle including a base member having a recess therein sized to receive the microfilm chip and a removable cover for sealingly closing the recess to protect the microfilm chip therein. In one embodiment described in U.S. Pat. No. 3,810,566, the receptacle takes the form of a locket adapted to be suspended on a chain around the wearer's neck and including a base member having a recess therein sized to accommodate a plurality of microfilm chips in back-to-back stacked relation.

Neither of U.S. Pat. No. 4,249,330 or U.S. Pat. No. 3,810,566 are directed to map holders, e.g., holders for ski area trail maps, to be consulted, e.g., while on a chair lift prior to downhill skiing or while stopped on a slope to refer to directions. More generally, neither of these two U.S. patents are directed to map holders wherein the person wearing the holder reviews the information therein. These two U.S. patents do not add anything to U.S. Pat. No. 4,415,106, in connection with providing holders for ski area trail maps.

Accordingly, the problems still remain of providing a map holder (e.g., a ski area trail map holder) that is readily accessible to the person possessing the map and to a companion, when desired, yet which can be retained in a protected location, out of sight, when not being used.

SUMMARY OF THE INVENTION

Accordingly, it is a first object of the present invention to provide an information holder (that is, a holder of printed information, such as a map holder) that is readily accessible to the person carrying the information holder, or to a companion, when the person carrying the information holder, or the companion, needs to refer to the information, yet which can be protected in a safe and, when appropriate, non-visible location when the person carrying the information holder, or the companion, does not need to refer to the information.

It is a second object of the present invention to provide a map holder, for example, for a skier, which is readily accessible for reference by the skier or companion when, for example, the skier is on a chair lift or stopped on a trail, but which can be kept in a protected and, when appropriate, non-visible location when the skier or companion is not referring to the map (e.g., while skiing).

It is a further object of the present invention to provide an information holder (for example, a map holder), whereby the map or other information, e.g., safety information or emergency instructions, can be easily read without the necessity of unfolding the map.

It is a still further object of the present invention to provide a map holder which can easily and effectively be stored in a protected and, when appropriate (e.g., while skiing), non-visible location, freeing the hands of the possessor of the map holder, yet which is readily accessible for use, e.g., by the person possessing the map holder or by a companion.

The objects of the present invention are achieved by an information (map) holder as in the present invention, having a first element for supporting, e.g., the printed information (map) and a second element attached to the first element and adapted to be worn around the neck of the person who will be referring to the information, the second element either being sufficiently long, or able to be stretched sufficiently long, so that the person can hold the information holder, containing the printed information, a sufficient distance from his eyes so that the information within the information holder can be read by such person or a companion.

Illustratively, the second element can be a string having a sufficient length, or an elastic member that can be stretched to a sufficient length, such that the information holder (while the second element is still around the neck of the person) can be held a sufficient distance from the person so that the information can be read by the person having the map holder around his neck, or by a companion (for example, another skier, sitting next to the person on a ski chairlift), for convenient, safe and effective review.

Illustratively, a ski area trail map for a ski area can be the information held within the holder, so that, for example, while the skier is on a chair lift the holder can be pulled out and the map read in preparation for further skiing.

Moreover, the map holder, when the map is not being referred to (for example, when the person is skiing) may, when appropriate and at the option of the user, be safely tucked away inside a jacket or sweater, thus in a protected location, so that the map holder is protected from any adverse conditions and also is non-visible so as not to destroy the "look" of the ski outfit.

In addition, by providing the map holder on, e.g., a string around the skier's neck, the map holder is accessible, and can be moved to a position where the map can be read without taking off ski gloves or poles; for example, by grabbing the string or elastic member extending around the neck to remove the map holder from the protected location, and moving the map holder (while the string or elastic is still around the skier's neck) to a location where the map can be read, on both sides of the holder, in a single and uncomplicated maneuver with or without removal of mittens or gloves, rather than by retrieving and unfolding a paper map which often requires removal of mittens or gloves.

Preferably, as a safety feature, the string or elastic member has a catch including a safety release such that, if the string or elastic member snags on an object (for example, on the chair lift) the map holder will be removed from the person without injury to the person.

The first element (that is, the map supporting member) can have several different embodiments, as will be discussed in the following. For example, the map supporting member can be made of a soft, flexible plastic and have transparent front and reverse sides, with a slot in the plastic wherein a map for one area (e.g., one ski area) can be slid into the map holder and replaceably removed; for example, replaced with a trail map of another ski area. In addition, the map supporting member could hold a credit card or cash.

Generally, the map supporting member should be water-resistant.

Alternatively, the map supporting member can be a laminated paper (paper sandwiched by plastic) with the map printed on the paper; or the map can be directly and, e.g., permanently printed on a plastic member. In either of these two alternative embodiments, the second element (that is, the means extending around the neck of the person) can hold the map holder by a hole through the laminated paper or plastic.

As another embodiment of the present invention, a trail map can be combined with a ski lift ticket or other identifier or access paper, the combination being held in the map supporting member and supported around the neck of the person by the neck-surrounding member, of the present invention.

In addition, in further embodiments, the map can be printed on one side, with other information, such as emergency information (for example, telephone numbers to call in case of injury, area road maps, etc.) printed on the other side and exposed through the reverse side of the map supporting member. This aspect of the present invention is particularly appropriate in connection with holders that are transparent on both the front and reverse sides, so that the trail map, and the information on the reverse side, can be seen without removal of the printed information from the holder.

In another embodiment, the map supporting member can be double-sized, but foldable, to provide a greater viewing area of the map when open. Various simple fastening means can be utilized to provide the map supporting member in its folded form while the information is not being read, yet which folded map supporting member can be easily opened so that a map contained therein can be read.

As an additional feature of the present invention, either or both faces of the map supporting member can include a magnification lens, so that information of a reduced size (e.g., in cases where such information is provided) can be used yet be easily readable by the person having the map holder or by a companion.

Accordingly, by the present invention the objectives as discussed above are achieved. Specifically, by use of the map supporting member and neck-surrounding member extending around the person's neck and having the specified length, the map holder can, if appropriate or desirable, be safely tucked away in a protected, non-visible location while not being read, yet is readily accessible when it is desired to read the map. Moreover, through use of the magnification lens as part of the map supporting member, a reduced-sized map can be used while still providing a map which is easily readable.

BRIEF DESCRIPTION OF THE DRAWINGS

FIG. 7A is an illustration of a fourth embodiment of the present invention, and FIG. 7B is an illustration of a magnification lens of the fourth embodiment.

FIG. 8 is a cross-sectional view of the fourth embodiment of the present invention.

DETAILED DESCRIPTION OF THE INVENTION

While the present invention will be described in connection with specific and preferred embodiments, it will be understood that it is not intended to limit the invention to those embodiments. To the contrary, it is intended to cover all alterations, modifications and equivalents as may be included within the spirit and scope of the invention as defined by the appended claims.

The present invention contemplates a map holder, or holder of other information, that is accessible when it is desired to read the information thereon and which may be kept, when not being used, in a protected and non-visible location, while retaining the map holder supported by the neck of a person (so as to reduce materially any risk of losing the map holder) both when reading the information and storing the holder. The map holder includes a first element for supporting the map and a second element for extending around the neck of a person. The second element (which can be a string or elastic member) has such a length, or can be stretched to such a length, that the map in the map holder and attached to the second element can be read by the person around whose neck the map holder extends, or by a companion, without removal of the second element from around the neck of the person. Thus, according to the present invention, a map holder is provided which can safely be retained in the possession of the person without real fear of losing the map holder, either while reading the map or while the map is not being read (e.g., while the person is skiing); and wherein the map can be safely tucked away from view and in a protected location during non-use, when appropriate or desirable, yet which is readily accessible when it is desired to read the map in the map holder. Such accessibility permits the map to be removed from its protected and non-visible location without removal of, e.g., ski gloves or mittens, or ski poles.

In the following, the present invention will be described in connection with various drawing figures and embodiments.

Figure 1:
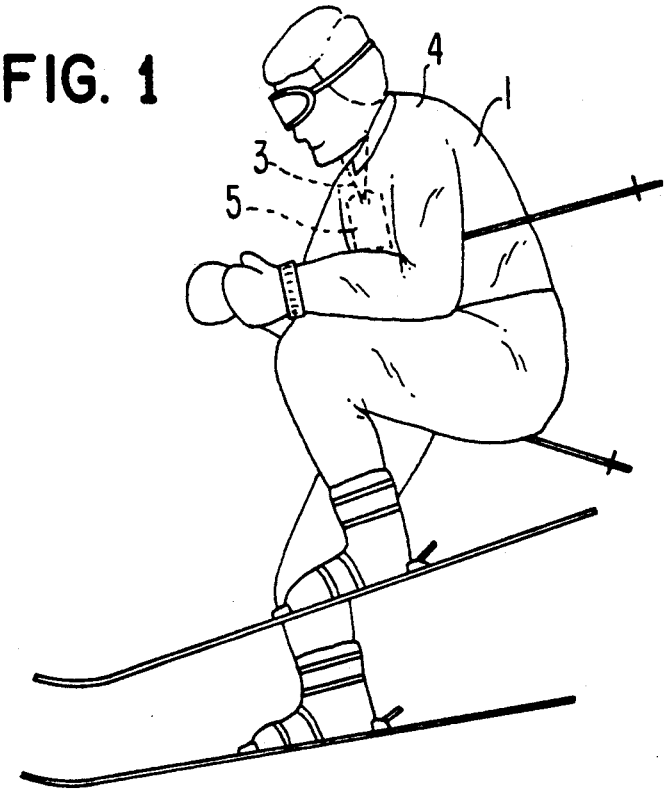
FIG. 1 illustrates the present invention, with the map holder stored in a protected and non-visible location.

FIG. 1 shows the present invention, with the map supporting member of the map holder tucked away in a protected and non-visible location. Specifically, a skier 1 has a string or elastic member 3 around his neck and attached to a map supporting member 5. A portion of the string or elastic member circling the skier's neck is readily accessible (e.g., exposed), with the remainder being tucked away within the ski jacket 4 of the skier 1. With the exposed portion of the string or elastic member 3, the map supporting member 5 is readily accessible to the skier; and, when skiing, the map supporting member can be safely tucked away inside the ski jacket in a protected and non-visible location.

Figure 2:
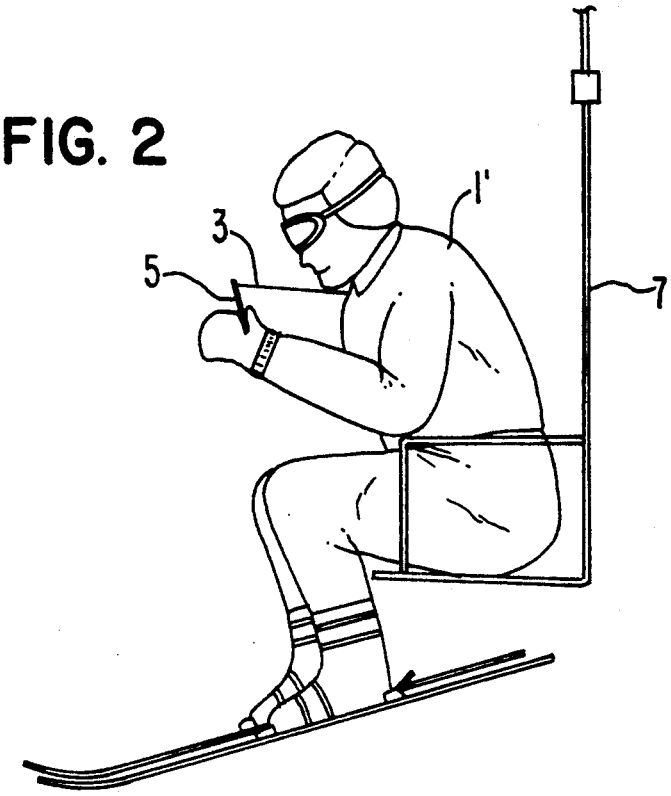
FIG. 2 illustrates the present invention with a person reading information from a map in the map holder.

FIG. 2 shows the map holder with the map being read by the skier. Namely, FIG. 2 shows a skier 1' on a chair 7 of a chair lift, having the exposed map supporting member 5 of the map holder in his hand. The string or elastic member 3 is sufficiently long, or can be stretched to a sufficient length, so that the map in the map supporting member 5 can be read by the skier 1', or even a companion of the skier, e.g., while both are on a chairlift or standing on a trail.

Figure 3A:
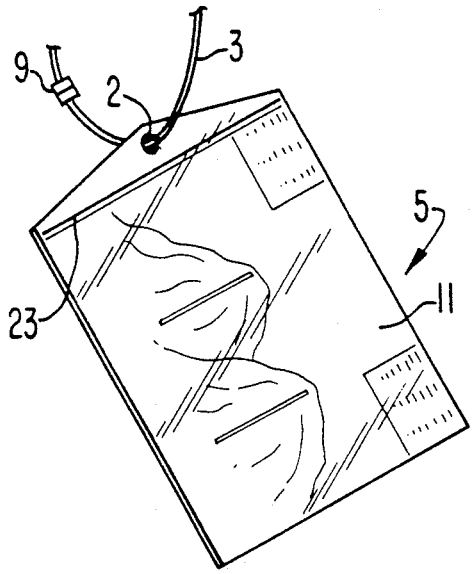
FIGS. 3A and 3B are front and rear perspective views of a first embodiment of a map holder of the present invention.
Figure 3B:
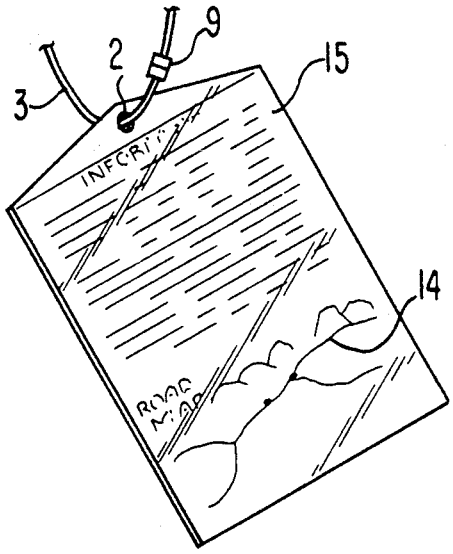

FIGS. 3A and 3B respectively show the front face 11 and rear face 15 of the map supporting member 5. The front face 11 has a ski trail map 13 exposed therethrough, for easy reference by the skier. Also shown in FIG. 3A is slot 23, whereby printed information (e.g., ski map 13) can be slipped in to be provided within the map supporting member 5.

Also shown in FIG. 3A is hole 2 at an end of the map supporting member 5, whereby the map supporting member can be held by the string or elastic member (neck-surrounding member) 3. As discussed previously, the neck-surrounding member is sufficiently long (or can be stretched to a sufficient length) such that the objectives of the present invention (that is, that the map can be read without removal of the map holder from around the neck) are achieved.

Also shown in FIG. 3A is catch 9 for the neck-surrounding member. This catch 9, desirably, provides a safety release (that is, opens when a predetermined level of pressure is applied to the neck-surrounding member) so as to prevent injury to the person having the neck-surrounding member around his neck. Such a safety release is known in the art.

FIG. 3B shows the reverse side of the map supporting member, having exposed printed information including, for example, road map 14 (for the general area around the ski area, for example) and emergency information 16 (for example, telephone numbers to be called in case of injury, blood type, etc.). Such exposed printed information is exposed through the rear face of the map supporting member 5. Of course, the information discussed herein is merely illustrative, and any desired information can be utilized and exposed through the rear face.

The map holder shown in FIGS. 3A and 3B illustrates a pocket-type map supporting member, having transparent front and rear faces with the printed information (e.g., ski area trail map) slipped into the pocket. Preferably, the map supporting member 5, in this embodiment, is made of a soft flexible plastic, having a size of, for example, 4 inches by 6 inches.

The map holder shown in FIGS. 3A and 3B can be formed by conventional techniques, such as forming two sheets of plastic of, e.g., a size of 4 inches by six inches; forming a slot across the top of one of the sheets; joining the two sheets together by, e.g., heat sealing, to form the pocket, forming a hole at the top of the sheets for the neck-surrounding member to pass therethrough, completing the map supporting member; and passing the neck-surrounding member through the hole in the map supporting member. Techniques for joining the two sheets together, such as heat sealing, are known.

Of course, the map supporting member is not limited to this structure, and can be a laminated paper, having the string or elastic through a hole at one end thereof; or can be a map printed directly on a plastic member; or can incorporate a magnification screen or lens or cover. Other techniques for providing printed information on a member, with the member held by a string or elastic member surrounding a person's neck, can also be utilized, according to the present invention.

Figure 4A:
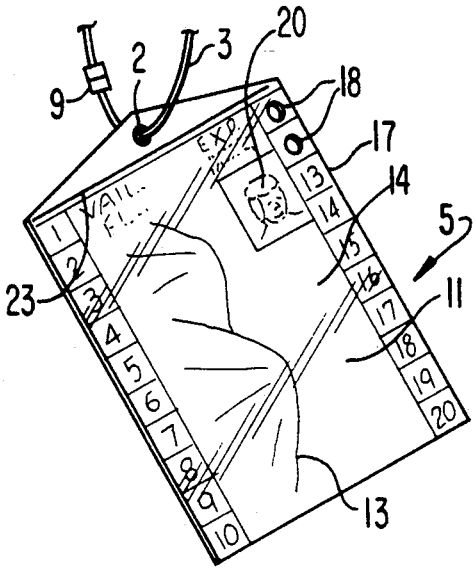
FIGS. 4A and 4B are front and rear perspective views of a second embodiment of a map holder of the present invention.
Figure 4B:
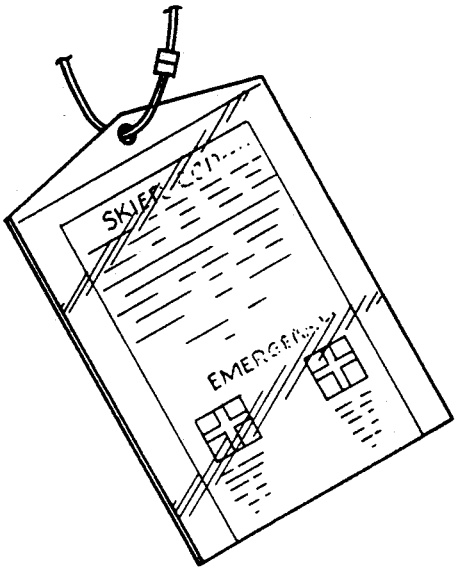

FIGS. 4A and 4B show a second embodiment according to the present invention, of a combination ski lift ticket and ski area trail map utilized as part of the present invention. Specifically, seen in FIG. 4A is a map supporting member 5 having, as the front face thereof, a series of numbers 17 bordering the map 13, exposed through the front face 11 of the map supporting member 5. Also shown in FIG. 4A is a picture 20 of the skier, for identification purposes. As is usual at ski areas, particularly wherein multiple-day passes are involved, the day of use can be punched out, as shown by reference character 18, to establish use of the ticket on a specific day. According to this aspect of the present invention, the skier can easily be provided with both a readily accessible ski ticket and trail map, having the advantages as discussed previously.

Shown in FIG. 4B is an illustrative reverse side for the combination ticket/trail map of FIG. 4A, showing printed information exposed through the rear face of the map supporting member 5. As seen in FIG. 4B, the reverse side of the combination ticket/trail map can contain emergency information (e.g., locations of telephones or ski patrol offices on the mountain, as well as rules of skiing (for example, who has the right of way on the mountain). Of course, and as discussed previously in connection with FIG. 3B, the information which can be provided on the reverse side of the combination ticket/-trail map is not limited.

Figure 5:
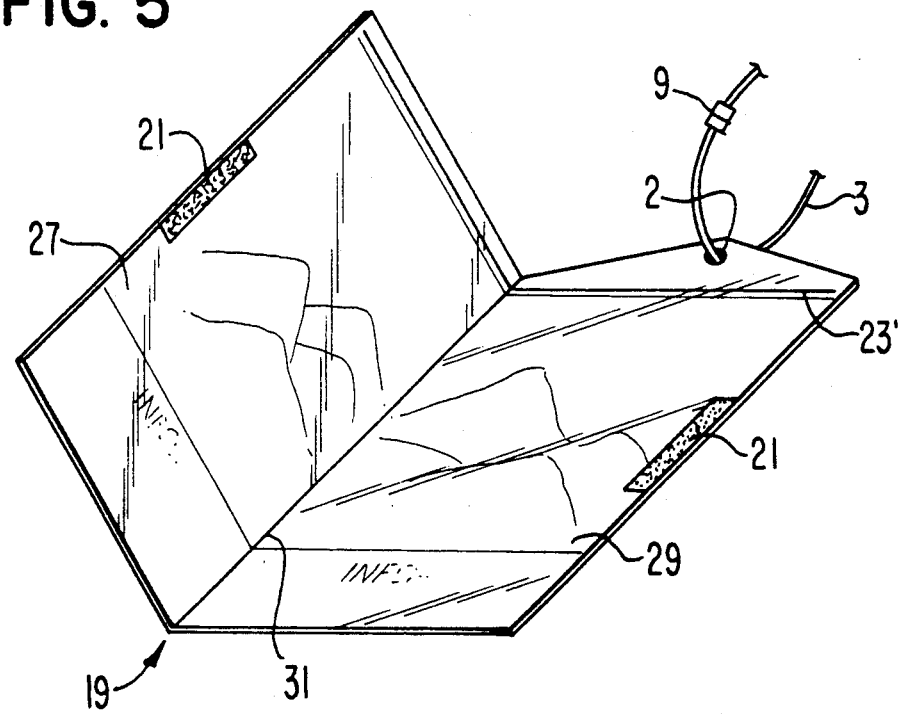
FIG. 5 is a schematic illustration of a third embodiment of the map holder of the present invention.

Shown in FIG. 5 is a folding-type map supporting member 19 according to the present invention. This folding-type map supporting member 19 has left- and right-sides 27, 29, respectively, with fold 31 therebetween. As seen in FIG. 5, the right-hand side 29 has a hole 2 at the top thereof, with the neck-surrounding member 3 passing therethrough for supporting and retaining the map supporting member 19 on the skier (specifically, on the neck of the skier). The map supporting member 19 also includes slot 23' extending across the right-hand and left-hand sides 27, 29, whereby a ski area trail map of larger size can be slid into the map supporting member 19. This folding-type map supporting member 19 is more suitable for slide-in/replacement maps, and can be utilized for maps of, for example, twice the size of those utilized in the previously described embodiments, without having a map holder (in the folded condition) of any greater size.

Also shown in FIG. 5 are fastening means 21, 21 for retaining the map supporting member 19 in a folded condition when the map is not being used. Illustratively, the members 21, 21 can be made of Velcro so as to provide easy closing and opening of the map supporting member 19.

Figure 6:
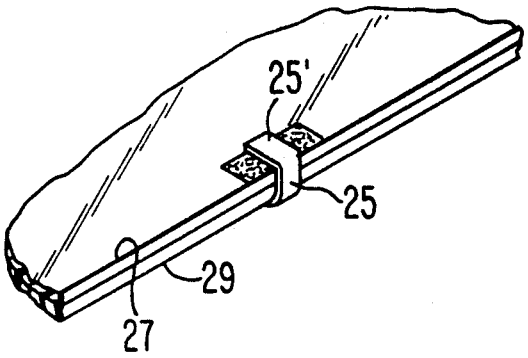
FIG. 6 is an illustration of a fastener for the third embodiment of the map holder of the present invention.

FIG. 6 shows an alternative embodiment for the fastening members holding the map supporting member 19 in the closed condition. Specifically, FIG. 6 shows strap 25 fixed to one of the two sides of the map supporting member 19, and which can be fastened to the other side (e.g., side 29) of the map supporting member 19. Illustratively, the side to which the strap 25 is not fixed can include a Velcro strip, with Velcro attached to the free end 25' of strap 25, whereby the strap 25 can easily be removably attached to side 29.

As with the other described embodiments, the rear surfaces of the map supporting member 19 (not shown in FIG. 5, but which would be exposed when the map holder 19 is closed) can also be transparent for exposing information (such as emergency information) contained on the reverse side of the ski area trail map. Desirably, the map supporting member 19 is made of plastic or other lightweight material, and, for example, resembles a wallet when closed.

While the present invention has been described in connection with various embodiments, the invention is not limited to such embodiments. For example, as a further alternative a plurality of ski area trail maps, of different ski areas, can be obtained and used when the skier skis (or the hiker hikes) a particular area; each ski area trail map could be directly printed on plastic or laminated paper, as individual map supporting members according to the present invention. In this aspect, each map supporting member/ski area trail map can be removed from a single neck-surrounding member, and each map supporting member/trail map is easily reusable. This aspect of the present invention is particularly appropriate for skiers utilizing various different ski areas, common in many ski locations.

As a further embodiment, the, e.g., front face of the map supporting member, through which the ski area trail map is exposed, can be provided as a magnification lens. An illustration of this embodiment is shown in FIGS. 7A, 7B and 8. In FIG. 7A, reference numerals as used previously represent structure as discussed previously. Front face 11', in FIG. 7A, differs from the previously disclosed front faces in constituting a magnifying structure. As one illustration, shown in FIG. 7B, the magnifying structure is a flexible magnification screen 39 having magnification grooves 35, formed as the front face 11' of the map supporting member. The magnification screen 39 having the magnification grooves 35, can be formed by conventional molding techniques.

Shown in FIG. 8 is a cross-section of the map holder 5 shown in FIG. 7A, along line X—X of FIG. 7A. FIG. 8 shows the map supporting member as a laminate with paper map 13 as the middle layer, sandwiched by plastic layers 37, 37. On surfaces of plastic layers 37, 37 not adjacent the paper map are provided the magnification screen 39 forming the front face 11', the magnification screen having the magnification grooves 35.

FIG. 8 shows a magnification screen provided for both the front and rear faces of the map supporting member. Of course, the screen can be provided for only one of the two faces (e.g., the front face, where the map is exposed through the front face).

According to this embodiment, the map used can be of a reduced size (so that either the map supporting member can be of a reduced size and/or the land area covered by the map is increased). This aspect of the present invention has the advantage that additional information can be included without disadvantageously increasing the size of the map supporting member, and/or ease of reading the map is increased.

Thus, plastic magnification lens, made by techniques known in the art, can be utilized as the front face of the map supporting member 5 according to this embodiment of the present invention.

While I have shown and described several embodiments in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims, and equivalents thereof.

What is claimed is:

1. A method of carrying and reading printed information, comprising the steps of:

placing a holder containing printed information around the neck of a person, said holder including (1) a neck-surrounding member to be removably retained around the neck of the person; and (2) a printed information supporting member, for supporting the printed information, such that the printed information is exposed, in the supporting member, to be read by said person, said supporting member being attached to and held by said neck-surrounding member, said neck-surrounding member achieving a sufficient length such that the printed information contained by the supporting member can be read by said person without the neck-surrounding member having to be removed from the person's neck, the holder being placed such that the neck-surrounding member is located around the neck of said person, with the supporting member tucked away in a protected location to prevent damage to the printed information from exposure to adverse conditions, wherein the neck-surrounding member is an elastic member;

removing the supporting member from said protected location, and positioning the supporting member so that the printed information can be read by the person, while the neck-surrounding member is maintained around the neck of the person, wherein in the positioning step the elastic member is stretched to a length which is sufficient such that the printed information, contained by the supporting member which is attached to the elastic member, can be ready by the person without the neck-surrounding member being removed from the person's neck, an unstretched length of the elastic member being insufficient to provide the supporting member a sufficient distance to be read by the person without being removed from the person's neck; and reading the printed information by the person while the neck-surrounding member is maintained around the neck of the person and the printed information is maintained in the supporting member, so that the printed information is read without removing the neck-surrounding member from around the neck of the person, the supporting member being maintained in its protected location and removed therefrom, positioned so that the printed information can be read by the person, and the printed information read by the person, all without removing the neck-surrounding member from around the neck of the person.

2. The method according to claim 1, wherein after the printed information is read the supporting member is re-positioned in said protected and location without moving the neck-surrounding member from around the neck of the person.

3. The method according to claim 1, wherein the supporting member is in the form of a pocket wherein at least one of front and rear surfaces thereof is translucent or transparent such that the printed information contained in the supporting member is exposed to be read by the person or companion, and wherein the supporting member has a slot such that the printed information can be slid into the supporting member and exposed through at least one of the front and rear surfaces.

4. The method according to claim 3, comprising the further step of removing said printed information from the supporting member and substituting therefor other printed information, through said slot.

5. The method according to claim 1, wherein the supporting member is a laminated paper member, the laminations sandwiching the paper being of water-resistant plastic, with the printed information being printed on the paper.

6. The method according to claim 1, wherein the supporting member is a plastic member of a water resistant plastic, having the printed information printed directly thereon.

7. The method according to claim 1, wherein the supporting member includes, as at least a face thereof through which the printed information is exposed, magnification structure, whereby the information can be of a reduced size yet still be read by the person.

8. The method according to claim 1, wherein the supporting member is a folded member having a left-hand side and a right-hand side with a fold therebetween, front faces of the left-hand side and right-hand side facing each other when the supporting member is folded, and wherein the positioning step includes unfolding the folded member so as to expose the respective front faces of the left-hand side and right-hand side, at least the front faces of the left-hand side and right-hand side being at least translucent so as to expose the printed information contained in the folded member.

9. The method according to claim 1, wherein, while said person is not reading the printed information, said supporting member is tucked away in said protected location.

10. The method according to claim 1, wherein said printed information is a map.

11. The method according to claim 1, wherein a portion of the neck-surrounding member is readily accessible to the person when the supporting member is tucked away in the protected location such that the supporting member can easily be removed from the protected location for reading the printed information.

12. The method according to claim 11, wherein said portion of the neck-surrounding member is exposed when the supporting member is tucked away in the protected location.

13. The method according to claim 1, wherein said protected location is a protected and non-visible location.

14. A method of carrying and reading a ski area trail map by a skier, comprising the steps of:

placing a holder containing said ski area trail map around the neck of said skier, said holder including (1) a neck-surrounding member to be removably retained around the neck of the skier; and (2) a map supporting member, for supporting the ski area trail map such that the trail map is exposed, in the map supporting member, to be read by said skier, said map supporting member being attached to and held by said neck-surrounding member, said neck-surrounding member achieving a sufficient length such that the trail map contained by the map supporting member can be read by said skier without the neck-supporting member having to be removed from the skier's neck, the holder being placed such that the neck-surrounding member is located around the neck of said skier, with the map supporting member tucked away in a protected location to prevent damage to the trail map from exposure to adverse conditions, wherein the neck-surrounding member is an elastic member;

removing the map supporting member from said protected location, and positioning the map supporting member so that the ski area trail map can be read by the skier, while the neck-surrounding member is maintained around the neck of the skier, wherein in the positioning step the elastic member is stretched to a length which is sufficient such that the ski area trail map, contained by the supporting member which is attached to the elastic member, can be read by the person without the neck-surrounding member being removed from the person's neck, an unstretched length of the elastic member being insufficient to provide the supporting member a sufficient distance to be read by the person without being removed from the person's neck; and reading the ski area trail map by the skier while maintaining the neck-surrounding member around the neck of the skier and maintaining the trail map in the map supporting member, so that the trail map is read without removing the neck-surrounding member from around the neck of the skier, the map supporting member being tucked away in the protected location and removed therefrom, positioned so that the ski area trail map can be read by the skier, and the ski area trail map read by the skier, without removing the neck-surrounding member from around the neck of the skier.

15. The method according to claim 14, wherein after the ski area trail map is read the map supporting member is re-positioned in said protected location without removing the neck-surrounding member from around the neck of the skier.

16. The method according to claim 14, wherein the skier is wearing a ski jacket, and the protected and non-visible location is inside the ski jacket.

17. The method according to claim 14, wherein the skier is wearing a sweater, and the protected and non-visible location is inside the sweater.

18. The method according to claim 14, wherein the map supporting member is removed from said protected and non-visible location, and the ski area trail map is read by the skier, while the skier is located on a conveying member for conveying the skier up a mountain.

19. The method according to claim 14, wherein the map supporting member is removed from said protected and non-visible location, and the ski area trail map is read by the skier, while the skier is stopped on a ski trail.

20. The method according to claim 14, wherein, while said skier is skiing and is not reading the ski area trail map, said map supporting member is tucked away in the protected location.

21. The method according to claim 14, wherein a portion of the neck-surrounding member is readily accessible to the skier when the supporting member is tucked away in the protected location such that the supporting member can easily be removed from the protected location, for reading the ski area trail map.

22. The method according to claim 21, wherein said portion of the neck-surrounding member is exposed when the supporting member is tucked away in the protected location.

23. The method according to claim 14, wherein said protected location is a protected and non-visible location.

* * * * *